US007802323B2

(12) United States Patent
Al-Mutairi

(10) Patent No.: US 7,802,323 B2
(45) Date of Patent: Sep. 28, 2010

(54) PORTABLE TOILET

(76) Inventor: Ahmad L. B. M. Al-Mutairi, Block 2, Street 2, House 653, Sabahiya (KW)

( * ) Notice: Subject to any disclaimer, the term of this patent is extended or adjusted under 35 U.S.C. 154(b) by 1148 days.

(21) Appl. No.: 11/375,004

(22) Filed: Mar. 15, 2006

(65) Prior Publication Data

US 2007/0214559 A1 Sep. 20, 2007

(51) Int. Cl.
*A47K 11/04* (2006.01)

(52) U.S. Cl. ..... 4/476; 4/480; 4/321; 4/420; 4/420.4

(58) Field of Classification Search ..... 4/476, 4/480, 321, 315, 420, 420.1–420.5, 443–448
See application file for complete search history.

(56) References Cited

U.S. PATENT DOCUMENTS 3,992,727 A * 11/1976 Elkins ..... 4/321
4,547,916 A * 10/1985 Henke et al. ..... 4/321
4,751,753 A * 6/1988 Sargent et al. ..... 4/321
5,251,342 A * 10/1993 Sansom et al. ..... 4/462
5,269,030 A * 12/1993 Pahno et al. ..... 4/480
5,659,901 A * 8/1997 Derakhshan ..... 4/420.1
5,842,237 A * 12/1998 Hargest et al. ..... 4/449
5,978,983 A * 11/1999 Queen et al. ..... 4/556
6,081,935 A * 7/2000 Kishi et al. ..... 4/321
6,694,538 B1 * 2/2004 Jones ..... 4/476
7,185,375 B1 * 3/2007 Movsas ..... 4/480
2007/0044222 A1 * 3/2007 Hedberg ..... 4/321

* cited by examiner

*Primary Examiner*—Khoa D Huynh
(74) *Attorney, Agent, or Firm*—Lowe Hauptman Ham & Berner, LLP

(57) ABSTRACT

A self-contained portable toilet for a patient's room includes a movable cabinet having a base and a plurality of wheels on the base and a brake for moving and securing the cabinet to a selected location. The cabinet also includes a water tank, a toilet bowl having an opening in the bottom portion thereof disposed in the cabinet at a pre-selected height. An excrement drawer is provided below the opening in the toilet bowl and a conduit provides water from the tank for cleaning a patient and/or the bowl. The cabinet also includes water level indicators for indicating the amount of water in the tank and in the excrement drawer. The drawer also includes an opening for receiving waste and a spring biased element for closing the opening when the drawer is removed from the cabinet.

2 Claims, 2 Drawing Sheets

FIG. 3
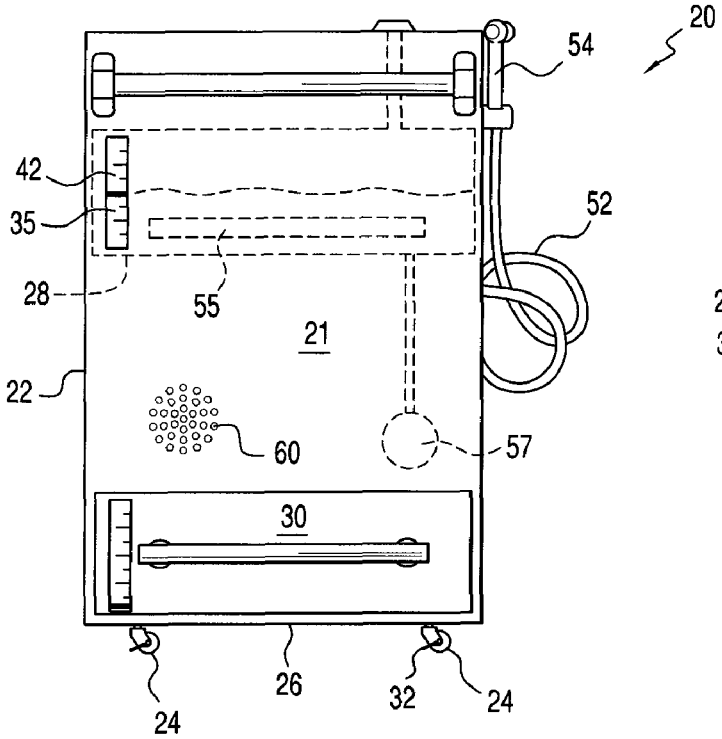
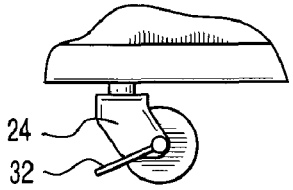
FIG. 3A
FIG. 5
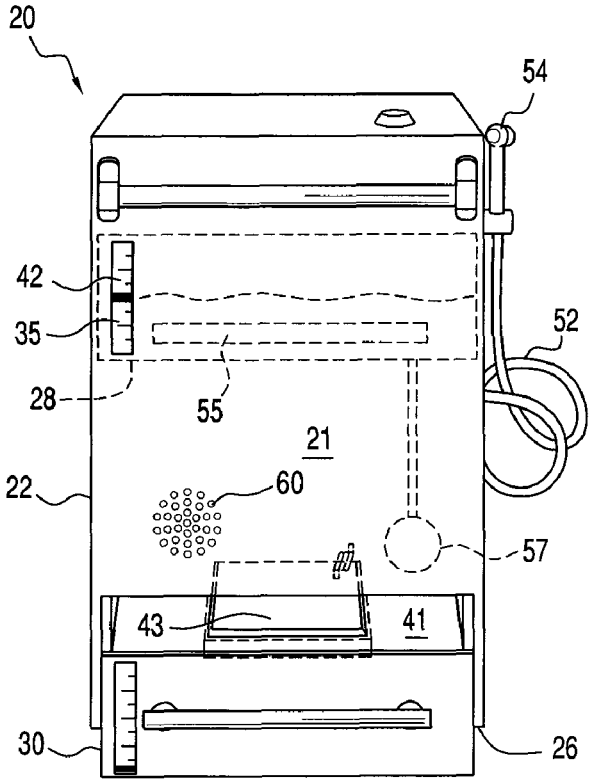
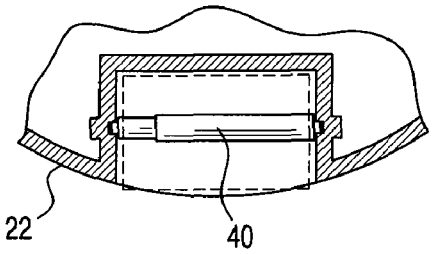
FIG. 4

PORTABLE TOILET

FIELD OF THE IN THE INVENTION

This invention relates to a portable toilet for a patient's room and more particularly to a self contained sanitary unit that can remain in a patient's room during a period of convalescence.

BACKGROUND FOR THE INVENTION

The concept of a modular bathroom is well known. For example, a U.S. Pat. No. 4,653,128 of Canalizo, discloses a compact bathroom unit made up of a single cabinet in which a hydraulic system, a drainage system and a system of regulating different fixtures are integrated. As disclosed, the modular bathroom includes a wash basin, a toilet and a shower.

A more recent development of Staudenmayer, U.S. Pat. No. 6,185,759 discloses a built-in sanitary furniture unit. As disclosed, a built-in furniture unit is provided with a fixedly mounted toilet, a shower, a shower tray, a rear wall ridgedly connected to the shower tray and a toilet seat moveably mounted on the rear wall. The built-in furniture unit is designed as a cubicle with the advantage that it can be installed for example in the bedroom of a person in need of nursing, so transforming the bedroom into a nursing care room. The unit includes a flush tank operated by a flush button. Located below the flush tank is a wastewater outlet from the toilet. This wastewater outlet is followed by a chopper and a pump, so that, the drain can be connected to a conventional washbasin drain 40. Similarly, the unit also discharges a drain from the shower tray into a wastewater outlet.

It is now believed that there is a need and a commercial market for an improved portable toilet for a patient's room in accordance with the present invention. There should be a commercial market for a toilet in accordance with the present invention because it allows a bedroom of a person in need of nursing care to be transformed into a nursing care room without a need for attaching the unit to a plumbing fixture. The portable toilet also facilitates moving the toilet into and out of a bedroom and to transport the units to another home. Further, the units are light in weight, durable, easily cleaned and serviced, relatively free of odor and can be manufactured and sold at a reasonable price.

BRIEF SUMMARY OF THE INVENTION

In essence a portable toilet for a patient's room in accordance with the present invention contemplates a moveable cabinet having a base and a set of wheels and brake disposed on said base for moving the cabinet into and out of a patient's room and for securing the cabinet in a selected location. The cabinet also includes a water tank and an opening for filling the water tank with water. This opening can be filled with water by attaching a hose to a water faucet or by carrying water in a suitable container and filling the tank. A toilet seat is positioned in the cabinet at a pre-selected height and supported for holding a person of normal adult weight. A toilet bowl having an opening in a bottom portion thereof is disposed below the toilet seat. There is also an excrement or waste drawer disposed in the bottom of the cabinet below the opening in the toilet bowl for receiving waste from the toilet bowl through the opening. The drawer is readily removable for waste disposal. The cabinet also includes means for delivering water from the water tank to the toilet bowl for cleaning the patient or water bowl. Further, the cabinet includes a water level indicator for indicating the amount of water in the tank and means for indicating the amount of waste in the excrement drawer.

A preferred embodiment of the invention also includes means for heating the water in the water tank and means for increasing the pressure in the water to facilitate cleaning of the toilet bowl.

The invention will now be described in connection with the accompanying drawings wherein like numerals have been used to identify like parts.

DESCRIPTION OF THE DRAWINGS

FIG. 3 is a rear view of the portable toilet shown in FIGS. 1 and 2 of the invention;

FIG. 3A is a side elevational view of a caster and brake as incorporated in a portable toilet in accordance with the present invention;

FIG. 4 is an elevational view of a toilet paper holder as used in a portable toilet in accordance with the invention; and FIG. 5 is a rear view of the portable toilet shown in FIGS. 1-4, but illustrating an open covered waste drawer in a lower portion thereof.

DESCRIPTION OF THE PREFERRED EMBODIMENTS OF THE INVENTION

Figure 1:
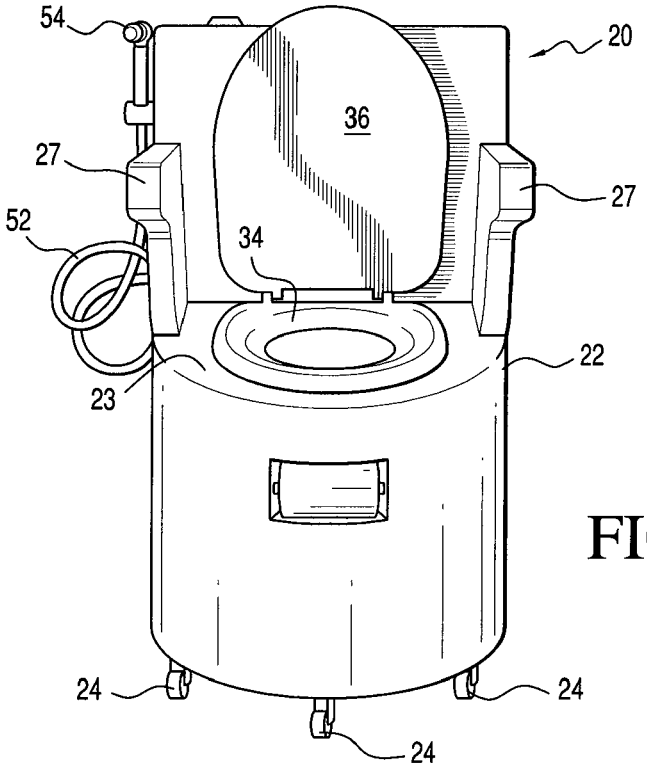
FIG. 1 is a front view of a portable toilet in accordance with the first embodiment of the invention.
Figure 2:
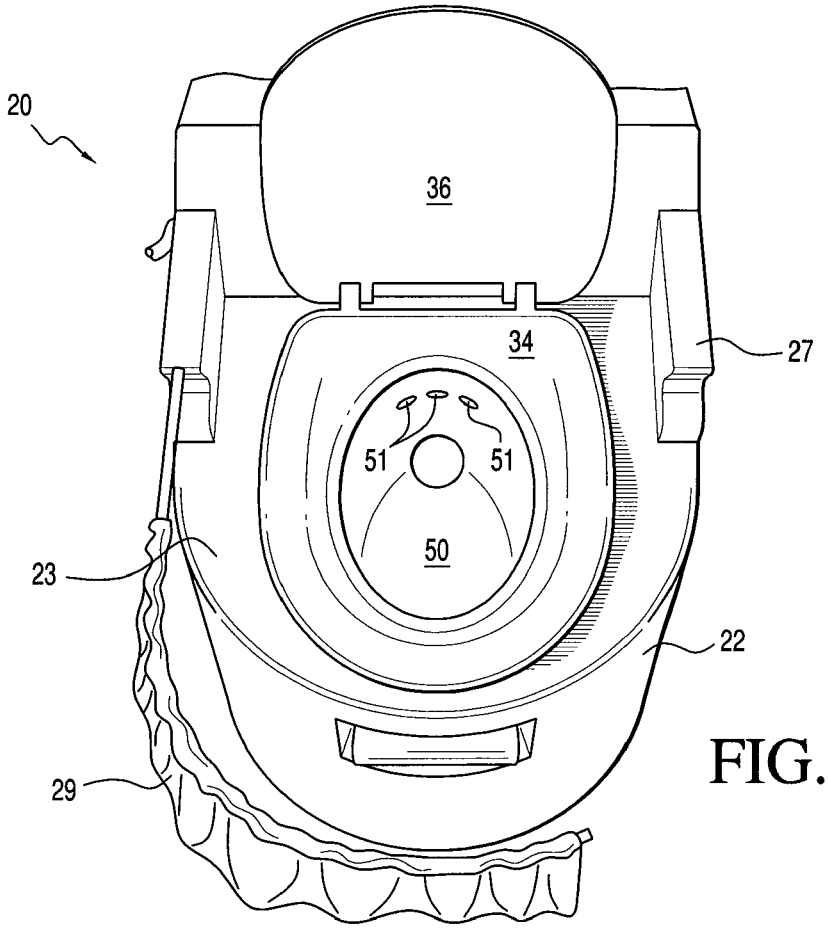
FIG. 2 is a front view of the portable toilet shown in FIG. 1 from a different perspective.

As shown in FIGS. 1-5, a portable toilet 20 for moving into or out of a patient's room includes an outer cabinet 22 or housing of a suitable plastic or the like. The cabinet will typically be made of a fiberglass reinforced plastic with a water resistant gel coat or other moldable plastic which can be engineered to support the weight of an adult as will be well understood by persons of ordinary skill in the art.

To facilitate movement into or out of a patient's room, the portable toilet 20 includes a plurality of wheels or casters 24 on the bottom 26 of the cabinet 22. In practice, the portable toilet 20 may be moved into a patient's room for the durations of convalescence and water added and waste removed while the unit remains in the room. However, it is also contemplated that in view of the portable units light weight and portability, it may be moved to a bathroom or the like for refilling a water tank 28 shown in FIG. 3 and for emptying a waste drawer 30 (see FIGS. 3 and 5). The cabinet 22 has a rear portion 21 having a generally rectangular cross-section and a substantially half oval-shaped forward portion 23. The forward portion may also include a pair of hand rails 27 or supports for aiding a patient to stand up after using the facilities.

A conventional brake 32 (FIG. 3A) is provided on the caster 26 (See FIG. 3A) to lock the toilet 20 in a pre-selected location and to prevent movement of the toilet during use. Further, the toilet 20 includes a conventional toilet seat having a seat 34 and hingedly connected lid 36. A toilet paper holder 40 as shown more clearly in FIG. 4 is recessed in a forward portion 23 of the cabinet 22. A privacy curtain 29 shown schematically in FIG. 2 may also be provided.

The water tank 28 is disposed in an upper part of the rear portion 21 of the cabinet 22 and preferably includes a water level indicator 42 (FIGS. 3 & 5) which is preferable visible from the front of the cabinet 22. The capacity of the water tank may exceed the capacity of the waste drawer 30 so that the waste drawer 30 can be emptied more than once between refilling the water tank 28. For example, the capacity of the waste drawer 30 may be about fifteen liters while the water tank 28 may be about fifty liters more or less. Therefore, a water level indicator 35 (FIGS. 3 & 5) is provided. In the latter case, a water level indicator may be used to provide a warning such as a red light (not shown) on an upper forward facing portion of a cabinet 22.

The toilet 20 also includes a conventional toilet bowl 50 defining an opening in a rear portion thereof for allowing waste to drop down into the waste drawer 30. It is also contemplated that the bowl 50 may include a thin non-porous ceramic or metal lining to avoid stains or discoloration and for ease in cleaning.

An important feature of the preferred embodiments of the invention resides in a flexible hose 52 and an on-off nozzle 54 connected to the water tank 28 for cleaning the toilet bowl 50. A plurality of nozzles 51 (shown schematically in FIG. 2) may also be provided for cleaning the bowl 50. A water heater 55 shown schematically in FIGS. 3 & 5 provides heated water for cleaning the toilet. In addition, a pump 57 and nozzle 54 may be provided to pressurize the water tank 28 or to increase the pressure of the water exiting the nozzle 54.

As shown in FIGS. 3 and 5 the portable toilet 20 preferably includes a vent 60 in a rear portion thereof which will be equipped with a conventional deodorizer similar to a conventional plug in deodorizer. The deodorizer, a light (not shown) for indicating the level of the waste in the waster drawer and water heater 55 are operatively connected to a rechargeable battery (not shown) or by an electrical connection to an electrical outlet (not shown).

Referring now to FIG. 5, the waste discharge drawer 30 is opened from the lower rear portion of the cabinet 22 and defines a generally closed box like structure with a cover top 41. The cover top 41 also defines an opening for waste and wash water to enter the drawer and a spring biased cover 43 that opens when the drawer is closed and closes when the drawer is removed from the toilet 20.

While the invention has been described in connection with its preferred embodiments, it should be recognized that changes and modifications may be made therein without departing from the scope of the appended claims.

What is claimed is:

1. A portable toilet for a patient's room comprising:

a cabinet made of reinforced fiberglass with a water resistant gel coating having a base and a set of wheels and brake on said base for moving said cabinet into and out of a patient's room and for securing said cabinet in a selected location, said cabinet having a rear portion with a generally rectangular cross-section and a substantially half oval-shaped forward portion and said forward portion including a pair of hand rails, said cabinet further having a water tank disposed on top of an upper rear portion of said rear portion of said cabinet, said water tank having an opening for filling said tank with water and means for heating the water in said water tank and a pump for increasing the pressure of the water to facilitate cleaning the toilet;

a toilet seat having a central opening, said toilet seat includes a hingedly connected lid, said toilet seat and said lid positioned on said oval-shaped forward portion of said cabinet at a pre-selected height, and a toilet bowl disposed within said cabinet, said toilet bowl including a thin non-porous ceramic or metal lining to avoid stains or discoloration and for ease of cleaning, and said toilet bowl having an opening in a bottom portion thereof, wherein said toilet bowl is aligned below said central opening of said toilet seat, wherein said pair of hand rails are disposed on both sides of said toilet seat for aiding a patient to stand up after using the portable toilet; and an excrement drawer disposed in a lower rear portion of said rear portion of said cabinet and beneath said water tank, said excrement drawer is placed below said toilet bowl for receiving excrement from said toilet bowl through said opening for disposal, a deodorant disposed adjacent said excrement drawer, wherein said excrement drawer is opened from said lower rear portion of said cabinet and defined a generally closed box structure with a cover, said cover having an opening for waste to enter said excrement drawer and spring bias means that closes said cover when said drawer is removed from said cabinet and opens said cover when said drawer is returned to said cabinet; and said cabinet including a flexible hose and an on/off nozzle that are connected to said water tank, said cabinet further includes a plurality of nozzles located in the toilet bowl, wherein said plurality of nozzles and said on/off nozzle are provided for delivering water from said water tank for cleaning the patient and/or the toilet bowl, and said cabinet comprising a first water level indicator including a light located on an upper forward facing portion of said cabinet for indicating the amount of water in said tank and a second level indicator disposed on said excrement drawer for indicating the level of waste in said excrement drawer, and a toilet paper dispenser located in a recess formed on said forward portion of said cabinet.

2. A portable toilet for a patient's room according to claim 1 which includes a privacy curtain.

* * * * *